US010125679B2

(12) United States Patent
Zahdeh

(10) Patent No.: US 10,125,679 B2
(45) Date of Patent: Nov. 13, 2018

(54) INDEPENDENT COMPRESSION AND EXPANSION RATIO ENGINE WITH VARIABLE COMPRESSION RATIO

(71) Applicant: GM GLOBAL TECHNOLOGY OPERATIONS LLC, Detroit, MI (US)

(72) Inventor: Akram R. Zahdeh, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 34 days.

(21) Appl. No.: 15/380,282

(22) Filed: Dec. 15, 2016

(65) Prior Publication Data

US 2017/0284291 A1 Oct. 5, 2017

Related U.S. Application Data

(60) Provisional application No. 62/314,578, filed on Mar. 29, 2016.

(51) Int. Cl.
*F02B 75/04* (2006.01)

(52) U.S. Cl.
CPC ..... *F02B 75/045* (2013.01)

(58) Field of Classification Search
CPC ..... F02B 75/045; F02B 75/048; F02B 75/04; F02D 15/02; F02D 15/00
USPC ..... 123/48 R, 48 A, 48 AA, 48 B
See application file for complete search history.

(56) References Cited

U.S. PATENT DOCUMENTS 1,909,372 A * 5/1933 McCollum ..... F02B 75/32 123/197.1
1,912,604 A * 6/1933 Valentine ..... F02B 41/04 123/197.1
5,163,386 A * 11/1992 Schechter ..... F02B 75/04 123/48 B
7,159,543 B2 * 1/2007 Hotta ..... F02D 15/02 123/48 B
8,087,390 B2 * 1/2012 Hiyoshi ..... F02B 75/048 123/48 A
8,397,683 B2 * 3/2013 Hiyoshi ..... F02B 75/048 123/48 A
9,476,366 B2 * 10/2016 Tanaka ..... F02B 75/048
(Continued)

FOREIGN PATENT DOCUMENTS

JP WO 2014027497 A1 * 2/2014 ..... F02B 75/048
JP WO 2016035127 A1 * 3/2016 ..... F02B 75/045

*Primary Examiner* — M. McMahon
*Assistant Examiner* — Tea Holbrook
(74) *Attorney, Agent, or Firm* — Quinn IP Law

(57) ABSTRACT

An internal combustion engine includes a crankshaft rotatably supported by an engine block, and rotatable about a crank axis. A control shaft is rotatably supported by the engine block, and rotatable about a control axis. A link rod is rotatably connected to the crankshaft. A lower connecting rod includes a first end rotatably connected to the link rod, and a second end rotatably connected to the control shaft. An upper connecting rod is rotatably connected to the link rod and a piston. The second end of the lower connecting rod and the control shaft are rotatably connected at a location offset from the control axis to define an eccentric connection relative to the control axis. Rotation of the control shaft about the control axis rotates the second end of the lower connecting rod about the control axis to adjust a compression stroke length of the piston.

17 Claims, 3 Drawing Sheets

(56) References Cited

U.S. PATENT DOCUMENTS

| | | | | |
|---|---|---|---|---|
| 2002/0050252 | A1* | 5/2002 | Moteki | F02B 75/045 123/48 B |
| 2003/0209213 | A1* | 11/2003 | Moteki | F02B 75/045 123/48 B |
| 2005/0268870 | A1* | 12/2005 | Hotta | F02D 15/02 123/78 F |
| 2009/0038588 | A1* | 2/2009 | Hiyoshi | F02B 75/048 123/48 B |
| 2010/0050992 | A1* | 3/2010 | Nakanishi | F02B 75/048 123/48 B |
| 2010/0180868 | A1* | 7/2010 | Scalzo | F02B 75/048 123/48 B |
| 2010/0192915 | A1* | 8/2010 | Tanaka | F02B 75/048 123/48 B |
| 2014/0060319 | A1* | 3/2014 | Van de Ven | F01B 9/02 92/140 |
| 2015/0176507 | A1* | 6/2015 | Tanaka | F02D 15/02 123/48 R |
| 2015/0361904 | A1* | 12/2015 | Mano | F02D 15/02 123/48 A |
| 2016/0348595 | A1* | 12/2016 | Kiyomura | F02D 15/02 |
| 2017/0096949 | A1* | 4/2017 | Shinozaki | F02D 15/02 |
| 2017/0145929 | A1* | 5/2017 | Hiyoshi | F02D 15/02 |
| 2017/0191409 | A1* | 7/2017 | Hiyoshi | F02B 75/045 |

* cited by examiner

INDEPENDENT COMPRESSION AND EXPANSION RATIO ENGINE WITH VARIABLE COMPRESSION RATIO

CROSS-REFERENCE TO RELATED APPLICATIONS

This application claims the benefit of U.S. Provisional Patent Application Ser. No. 62/314,578, filed on Mar. 29, 2016, the disclosure of which is hereby incorporated by reference.

TECHNICAL FIELD

The disclosure generally relates to an internal combustion engine.

BACKGROUND

Internal combustion engines include a piston that is slideably moveable within a cylinder bore of an engine block. The piston moves in a reciprocating motion through at least a compression stroke, having a compression stroke length, and an expansion stroke having an expansion stroke length. In a standard Otto cycle internal combustion engine, a connecting rod is eccentrically connected to a crankshaft relative to a crank axis. The connecting rod interconnects the piston and the crankshaft. Rotation of the crankshaft moves the piston through its compression and expansion strokes, with the compression stroke length being equal to the expansion stroke length.

An Atkinson cycle internal combustion engine uses a system of linkages to interconnect the piston and the crankshaft to a parallel control shaft. The unique linkage system of the Atkinson cycle engine enables the compression stroke length to be less than the expansion stroke length. By reducing the compression stroke length relative to the expansion stroke length, the compression ratio is less than the expansion ratio. This increases the fuel economy of the engine during some operating conditions.

A compression ratio is one of the fundamental specifications of an internal combustion engine. An internal combustion engine's compression ratio is a value that represents the ratio of the volume of the engine's combustion chamber from its largest capacity to its smallest capacity. In a reciprocating internal combustion engine, the compression ratio is typically defined as the ratio between the volume of the cylinder and combustion chamber when the piston is at a bottom of its compression stroke, and the volume of the combustion chamber when the piston is at a top of its compression stroke.

A more modern variation of the Atkinson cycle internal combustion engine is a Miller cycle internal combustion engine. The Miller cycle engine uses valve timing to achieve the results provided by the linkage system of the Atkinson cycle engine, i.e., the compression stroke length being shorter than the expansion stroke length. The Miller cycle engine uses valve timing to hold open the intake valve during the initial phases of the compression stroke, thereby effectively shortening the effective compression stroke length. The use of Miller cycle internal combustion engines is gaining popularity due to potential fuel economy gains. At low loads and low engine speeds, Miller cycle engines provide significant fuel economy savings, especially when combined with a high compression ratio to take advantage of thermal efficiency gains. However, at high loads and high engine speeds, Miller cycle engines with a high compression ratio become extremely spark limited, to a point where the maximum power potential of the engine is unachievable.

SUMMARY

An internal combustion engine is provided. The internal combustion engine includes an engine block that defines a cylinder bore. A piston is slideably supported within the cylinder bore. A crankshaft is rotatably supported by the engine block, and is rotatable about a crank axis. A control shaft is rotatably supported by the engine block, and is rotatable about a control axis. The control axis is parallel with and laterally offset from the crank axis. A link rod is rotatably connected to the crankshaft. A lower connecting rod includes a first end that is rotatably connected to the link rod, and a second end that is rotatably connected to the control shaft. An upper connecting rod includes a first end that is rotatably connected to the link rod, and a second end that is rotatably connected to the piston. The second end of the lower connecting rod and the control shaft are rotatably connected at a location offset from the control axis to define an eccentric connection between the lower connecting rod and the control shaft relative to the control axis.

The second end of the lower connecting rod is moveable relative to the crankshaft to adjust a compression stroke length of the piston within the bore during a compression stroke of the piston. More specifically, rotational movement of the control shaft about the control axis rotates the second end of the lower connecting rod about the control axis to adjust the compression stroke length of the piston within the bore during the compression stroke of the piston.

Accordingly, by moving the second end of the lower connecting rod, the compression stroke length may be changed. Changing the compression stroke length changes the compression ratio. Accordingly, moving the second end of the lower connecting rod changes the compression ratio of the internal combustion engine, thereby providing an internal combustion engine having a variable compression ratio. The internal combustion engine as set forth herein has a compression stroke length that is shorter than the expansion stroke length, with the ability of changing or adjusting the compression stroke length to change the compression ratio. This enables the internal combustion engine to efficiently operate using the Miller cycle at low loads and engine speeds with a high compression ratio, and then shorten the compression stroke length to reduce the compression ratio so that the internal combustion engine may efficiently operate at high loads and high engine speeds.

The above features and advantages and other features and advantages of the present teachings are readily apparent from the following detailed description of the best modes for carrying out the teachings when taken in connection with the accompanying drawings.

DETAILED DESCRIPTION

Those having ordinary skill in the art will recognize that terms such as "above," "below," "upward," "downward,"

"top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Figure 1:
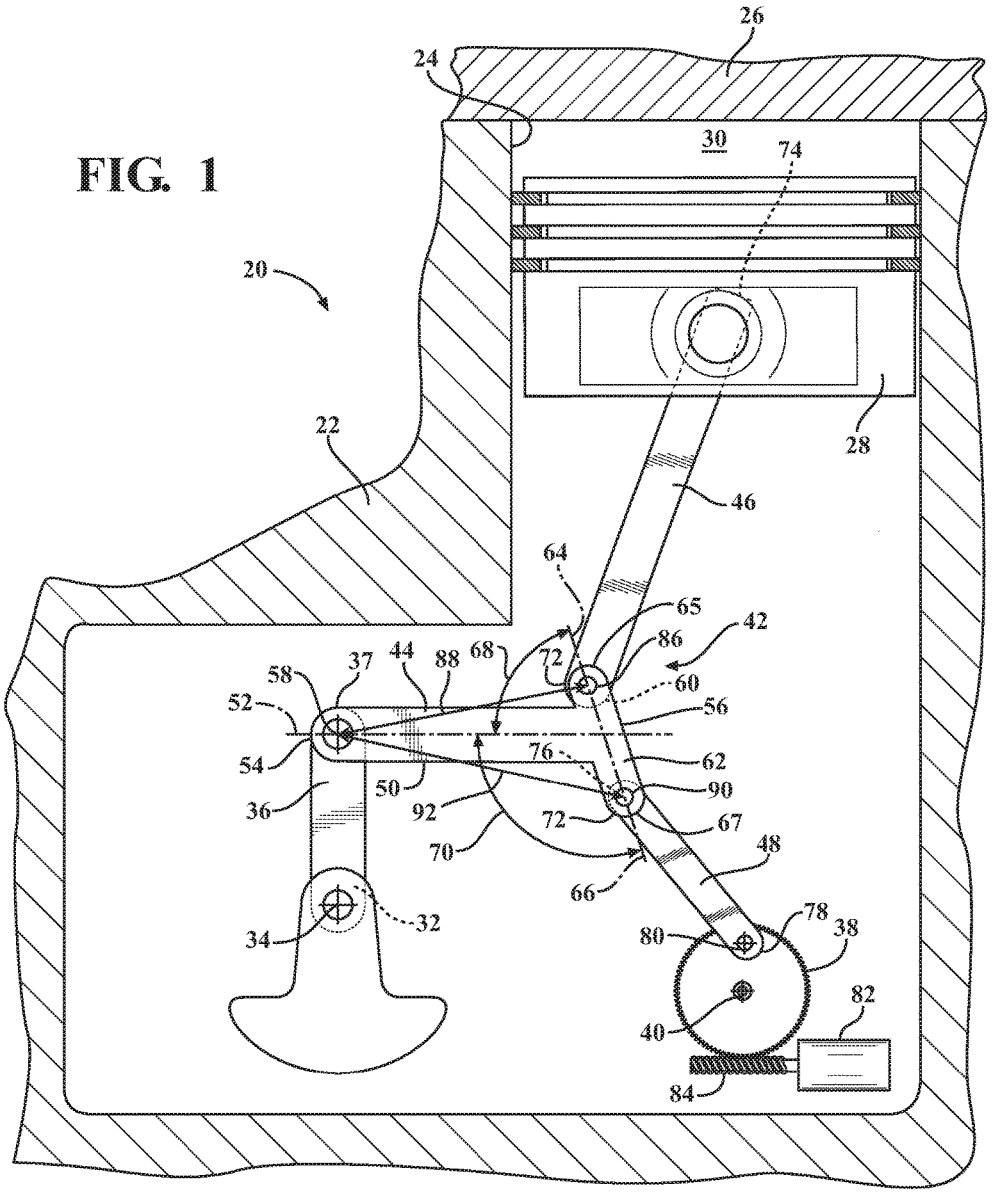
FIG. 1 is a schematic partially cross sectioned view of an internal combustion engine showing a control shaft in a first rotational position.
Figure 2:
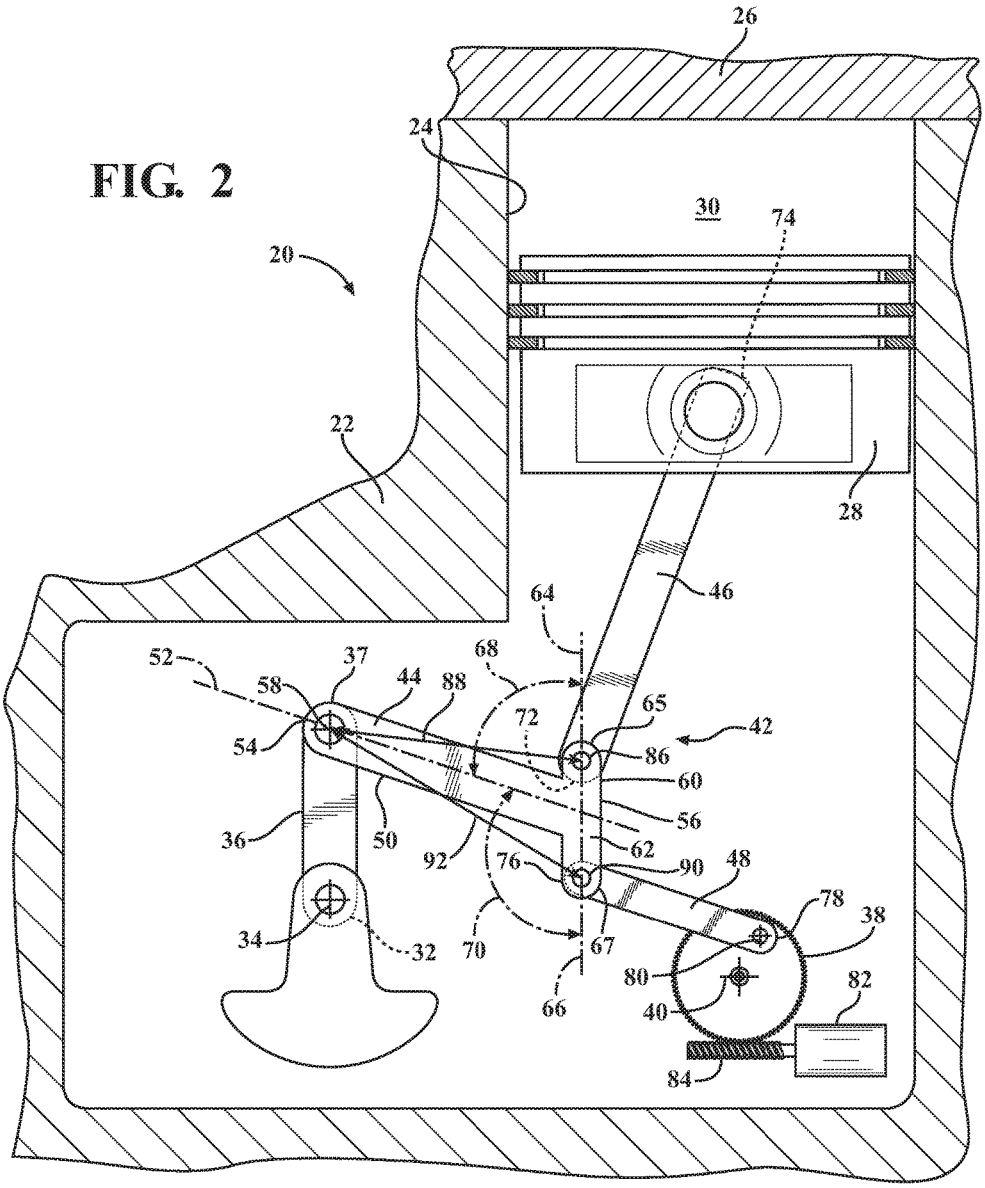
FIG. 2 is a schematic partially cross sectioned view of the internal combustion engine showing the control shaft in a second rotational position.

Referring to the Figures, wherein like numerals indicate like parts throughout the several views, an internal combustion engine is generally shown at 20 in FIGS. 1 and 2. Referring to FIGS. 1 and 2, the internal combustion engine 20 includes an engine block 22, which defines at least one cylinder bore 24. While the Figures only show a single cylinder bore 24 in the engine block 22, it should be appreciated that the engine block 22 may be configured to include multiple cylinder bores 24. For example, the engine block 22 may be configured as a V-style engine having 2, 4, 6, 8, or 10 cylinder bores 24, or as an inline style engine having one or more cylinder bores 24. It should be appreciated that the engine block 22 may be configured in a manner other than the exemplary V-style or inline style engines noted above, and may include any number of cylinder bores 24 other than the exemplary numbers described herein.

A cylinder head 26 is attached to the engine block 22, adjacent an upper end of the cylinder bore 24. The cylinder head 26 may include, but is not limited to, an intake valve, an exhaust valve, a fuel injector, a glow plug, or other devices suitable for the specific intended operation of the internal combustion engine 20 as is known in the art.

A piston 28 is slideably supported within the cylinder bore 24. It should be appreciated that each cylinder bore 24 of the engine block 22 includes a respective piston 28 slideably disposed within its respective cylinder bore 24. The piston 28 is slideably supported within the cylinder bore 24 for reciprocating movement within the cylinder bore 24. The piston 28 moves in a reciprocating motion through at least a compression stroke having a compression stroke length, and an expansion stroke having an expansion stroke length. The expansion stroke may alternatively be referred to as a combustion stroke. The cylinder head 26, the walls of the cylinder bore 24, and the piston 28 cooperate together to define a chamber 30 therebetween. A cycle of the internal combustion engine 20, including the compression stroke and the expansion stroke, is described in greater detail below with reference to FIG. 3.

A crankshaft 32 is rotatably supported by the engine block 22. The crankshaft 32 may be coupled to and rotatably supported to the engine block 22 in any suitable manner. For example, the crankshaft 32 may be rotatably supported by a plurality of bearings, and secured to the engine block 22 with a plurality of crank caps as is known in the art. The crankshaft 32 is rotatable about a crank axis 34. The crank axis 34 is defined by the crankshaft 32, and may be considered the central longitudinal axis of the crankshaft 32. The crankshaft 32 includes at least one crank arm 36. The crank arm 36 extends away from the crank axis 34 to a distal end 37 defining a crank pin. It should be appreciated by those skilled in the art, that if the internal combustion engine 20 includes multiple cylinder bores 24 and pistons 28, then the crankshaft 32 will likewise include multiple crank arms 36 and crank pins.

A control shaft 38 is rotatably supported by the engine block 22. The control shaft 38 may be coupled to and rotatably supported to the engine block 22 in any suitable manner. For example, the control shaft 38 may be rotatably supported by a plurality of bearings, and secured to the engine block 22 with a plurality of caps or clamps. The control shaft 38 is rotatable about a control axis 40. The control axis 40 is parallel with and laterally offset from the crank axis 34. The control axis 40 is defined by the control shaft 38, and may be considered the central, longitudinal axis of the control shaft 38.

The internal combustion engine 20 includes a linkage system 42 that interconnects the piston 28, the crankshaft 32, and the control shaft 38. The linkage system 42 includes a link rod 44, an upper connecting rod 46, and a lower connecting rod 48. The linkage system 42 translates linear movement of the piston 28 within the cylinder bore 24 into rotational movement of the crankshaft 32.

The link rod 44 is rotatably connected to the crankshaft 32, the upper connecting rod 46, and the lower connecting rod 48. The link rod 44 includes a long arm portion 50 that extends along a long arm axis 52, between a first end 54 and a second end 56. The link rod 44 is connected to the crank arm 36 at the first end 54 of the long arm portion 50. More specifically, the first end 54 of the long arm portion 50 is connected to the crank arm 36 adjacent the distal end 37 of the crank arm 36, at the crank pin. The link rod 44 is rotatable about a first axis 58 relative to the crank arm 36. The first axis 58 is defined by the crank pin. The first axis 58 is parallel with and laterally offset from the crank axis 34. Accordingly, the first end 54 of the long arm portion 50 is connected to the crank pin at an eccentric location relative to the crank axis 34.

As described above, the link rod 44 includes the long arm portion 50. Additionally, the link rod 44 includes an upper arm portion 60 and a lower arm portion 62. The upper arm portion 60 extends away from the long arm axis 52 of the long arm portion 50, along an upper arm axis 64, to a distal end 65. The lower arm portion 62 extends away from the long arm axis 52 of the long arm portion 50, along a lower arm axis 66, to a distal end 67. The upper arm portion 60 and the lower arm portion 62 are disposed on opposite sides of the long arm portion 50. Accordingly, the long arm portion 50, the upper arm portion 60, and the lower arm portion 62 form a generally "T" shaped structure. The long arm axis 52 of the long arm portion 50 and the upper arm axis 64 of the upper arm portion 60 form an upper angle 68 therebetween. The upper angle 68 may be between 30° and 90°. However, it should be appreciated that the upper angle 68 may differ from the exemplary range provided herein. The long arm axis 52 of the long arm portion 50 and the lower arm axis 66 of the lower arm portion 62 form a lower angle 70 therebetween. The lower angle 70 may be between 90° and 150°. However, it should be appreciated that the lower angle 70 may differ from the exemplary range provided herein. In some embodiments, the upper angle 68 and the lower angle 70 are complimentary angles. As used herein, the term "complimentary angles" are defined as angles that add up to equal 180°. However, in other embodiments, it should be appreciated that the upper angle 68 and the lower angle 70 may not be complimentary angles. In an exemplary embodiment, the upper angle 68 is approximately equal to 75°, and the lower angle 70 is approximately equal to 105°.

The upper connecting rod 46 includes a first end 72 and a second end 74. The first end 72 of the upper connecting rod 46 is rotatably connected to the link rod 44. More specifically, the first end 72 of the upper connecting rod 46 is connected to the link rod 44 adjacent the distal end 65 of the upper arm portion 60 of the link rod 44 at an upper connection location 86. The upper connection location 86 is spaced from the first axis 58 by an upper separation distance 88. The second end 74 of the upper connecting rod 46 is rotatably connected to the piston 28, as is known in the art.

The lower connecting rod 48 includes a first end 76 and a second end 78. The first end 76 of the lower connecting rod 48 is rotatably connected to the link rod 44. More specifically, the first end 76 of the lower connecting rod 48 is connected to the link rod 44 adjacent the distal end 67 of the lower arm portion 62 of the link rod 44 at a lower connection location 90. The lower connection location 90 is spaced from the first axis 58 by a lower separation distance 92. The upper separation distance 88 is less than the lower separation distance 92, such that the upper connection location 86 is disposed nearer the first axis 58 than the lower connection location 90. The second end 78 of the lower connecting rod 48 is rotatably connected to the control shaft 38. The second end 78 of the lower connecting rod 48 and the control shaft 38 are rotatably connected to each other for rotation relative to each other about a second axis 80. Accordingly, the lower connecting rod 48 is rotatable about the second axis 80 relative to the control shaft 38. The second axis 80 is parallel with and laterally offset from the control axis 40. As such, the second end 78 of the lower connecting rod 48 and the control shaft 38 are connected to each other for rotation about the second axis 80 at a location that is offset from the control axis 40, to define an eccentric connection between the lower connecting rod 48 and the control shaft 38 relative to the control axis 40.

An actuator 82 is coupled to the control shaft 38. The actuator 82 is operable to rotate the control shaft 38 about the control axis 40. Rotational movement of the control shaft 38 about the control axis 40 rotates the second end 78 of the lower connecting rod 48 about the control axis 40. FIG. 1 shows the control shaft 38 in a first rotational position relative to the control axis 40, and FIG. 2 shows the control shaft 38 rotated relative to the location shown in FIG. 1, in a second rotational position relative to the control axis 40. Rotation of the second end 78 of the lower connecting rod 48 about the control axis 40 repositions the second end 78 of the lower connecting rod 48 relative to the crankshaft 32 and the engine block 22, which thereby alters the relative positions and movement of the linkage system 42 during a rotational cycle of the crankshaft 32. Accordingly, the second end 78 of the lower connecting rod 48 may be rotated about the control axis 40, by rotating the control shaft 38 about the control axis 40, to adjust the compression stroke length of the piston 28 within the cylinder bore 24 during the compression stroke of the piston 28. Accordingly, the actuator 82 is operable to move the lower connecting rod 48 relative to the crankshaft 32 and/or the engine block 22 to adjust the compression stroke length of the piston 28.

The actuator 82 may include any style and/or configuration, including any necessary gearing or connections 84, that is capable of rotating the control shaft 38 about the control axis 40. For example, the actuator 82 may include a linear actuator or a rotational actuator. As understood by those skilled in the art, a rotational actuator produces a rotational output. An example of a rotational actuator includes, but is not limited to, and electric stepper motor. However, it should be appreciated that the rotational actuator may include some other device not described herein. The rotational actuator may be coupled to the control shaft 38 through worm gear or other type of gearing system. As understood by those skilled in the art, a linear actuator produces a linear output, i.e., linear movement. An example of a linear actuator may include, but is not limited to, a hydraulically or pneumatically actuated spool valve. A linear actuator may alternatively use a mechanism, such as but not limited to a ball screw mechanism, to convert rotation into linear movement. The linear actuator may be coupled to the control shaft 38 at an eccentric location relative to the control axis 40 to generate a torque in the control shaft 38 in response to linear movement to rotate the control shaft 38.

While the exemplary embodiment shown and described herein includes the actuator 82 being coupled to the control shaft 38, which is in turn connected to the second end 78 of the lower connecting rod 48, it should be appreciated that the actuator 82 may alternatively be directly coupled to the second end 78 of the lower connecting rod 48. In such a configuration, the actuator 82 would directly control the position and movement of the second end 78 of the lower connecting rod 48 to control the compression stroke length during the compression stroke of the piston 28. Such a configuration would eliminate the need for the control shaft 38.

Figure 3:
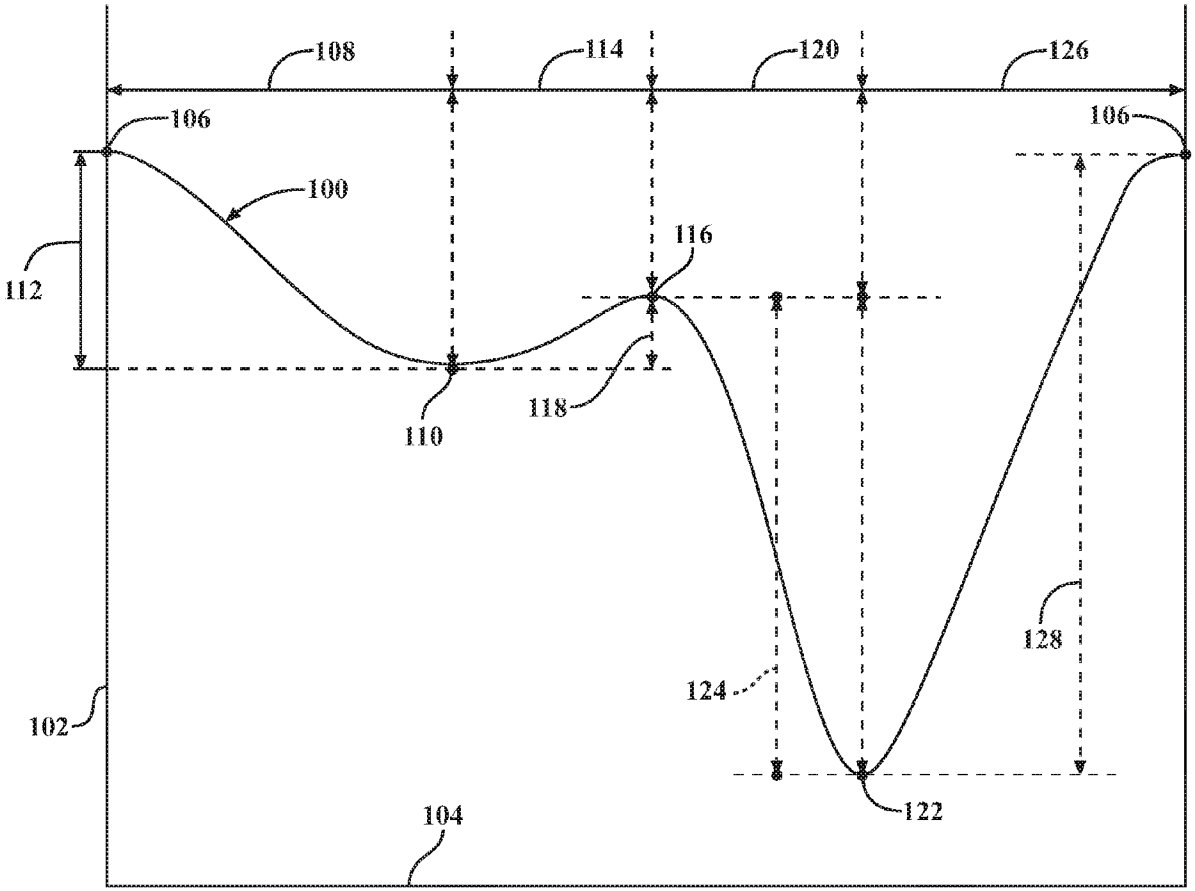
FIG. 3 is a graph showing a piston stroke during one engine cycle.

As noted above, the linkage system 42 described above moves the piston 28 through an engine cycle 100. Referring to FIG. 3, an exemplary graph of the engine cycle 100 of the internal combustion engine 20 is generally shown at 100. The position of the piston 28 is generally shown along a vertical axis 102, and the stage or time duration of the cycle is generally shown along a horizontal axis 104. A Top Dead Center (TDC) of the piston 28 at the end of an exhaust stroke and at a beginning of an intake stroke is generally shown at point 106. Accordingly, because the graph of FIG. 3 shows a complete cycle of the piston 28, the TDC 106 of the piston 28 at the end of the exhaust stroke and the beginning of the intake stroke occurs at both the far left and far right ends of the engine cycle 100 as viewed on the page of FIG. 3.

Beginning the description of the engine cycle 100 at the TDC 106 of the piston 28 at the far left side of the engine cycle 100 shown in FIG. 3, the piston 28 moves downward within the cylinder bore 24 and begins the intake stroke, in which an intake valve in the cylinder head 26 is opened to allow fuel and combustion air to enter the combustion chamber 30. The intake stroke is generally shown by dimension line 108. The end of the intake stroke occurs at point 110. The intake stroke of the piston 28 includes an intake stroke length shown by dimension line 112. At the end of the intake stroke 108, the intake valve closes and the piston 28 begins moving upward within the cylinder bore 24 toward the cylinder head 26, and begins the compression stroke of the piston 28. The compression stroke of the piston 28 is generally shown by dimension line 114. The end of the compression stroke occurs at point 116. The compression stroke length is generally shown by dimension line 118. At the end of the compression stroke 114, the fuel air mixture is ignited and the piston 28 begins moving downward, away from the cylinder head 26, and begins the combustion or expansion stroke, during which the ignited fuel air mixture rapidly expands and forces the piston 28 downward within the cylinder bore 24. The expansion stroke of the piston 28 is generally shown by dimension line 120. The end of the expansion stroke occurs at point 122. The expansion stroke length is generally shown by dimension line 124. At the end of the expansion stroke 120, an exhaust valve is opened in the cylinder head 26 and the piston 28 begins moving upward in the cylinder bore 24 toward the cylinder head 26 to exhaust the combusted gasses through the exhaust valve. This begins the exhaust stroke. The exhaust stroke is generally shown by dimension line 126. The end of the exhaust stroke occurs at the TDC 106 of the piston 28, shown at the far right of the engine cycle 100 of FIG. 3. The exhaust stroke 126 includes an exhaust stroke length that is generally shown by dimension line 128.

The graph of the engine cycle 100 shown in FIG. 3 shows that the compression stroke length 118 is less than the expansion stroke length 124. By changing the position of the lower connecting rod 48, e.g., by rotating the control shaft 38 to thereby rotate the second end 78 of the lower connecting rod 48, the movement or path that the linkage system 42 follows is altered, which changes the compression stroke length 118 of the piston 28. By changing the compression stroke length 118 of the piston 28, the compression ratio of the internal combustion is changed. By shortening the compression stroke length 118 by very little, such as for example, 1 or 2 mm, the compression ratio of the internal combustion engine 20 that occurs during the compression stroke 114 is significantly reduced. Accordingly, by controlling the position of the lower connecting rod 48, the compression ratio of the internal combustion engine 20 may be controlled, and changed between a high compression ratio during certain engine operating conditions, and a low compression ratio during other engine operating conditions. The internal combustion engine 20 described herein provides a variable compression ratio engine that enables the use of an Atkinson cycle, in which the compression stroke length 118 is less than the expansion stroke length 124, in both high load and high engine speed conditions and low load and low engine speed conditions, to achieve the fuel economy benefits that may be realized from the Atkinson cycle for all operating conditions of the internal combustion engine 20.

It should be appreciated that dimensional aspects of the linkage system 42 may be specifically designed to control the engine cycle 100. For example, the upper angle 68 and the lower angle 70 may be varied. A length of the link rod 44, between the first end 54 and the second end 56 of the long arm portion 50 may be varied. A length of the upper arm portion 60 of the link rod 44, between the long arm axis 52 and the distal end 65 of the upper arm portion 60 may be varied. A length of the lower arm portion 62 of the link rod 44, between the long arm axis 52 and the distal end 67 of the lower arm portion 62 may be varied. A length of the lower connecting rod 48, between the first end 76 and the second end 78 of the lower connecting rod 48, may be varied. The specific lengths and angles of the various components of the internal combustion engine 20 will of course depend on the specific size and configuration of the internal combustion engine 20. However, it should be appreciated that the various components of the linkages system may be varied to control the engine cycle 100 in order to optimize performance of the internal combustion engine 20.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. An internal combustion engine comprising:

an engine block defining a cylinder bore;

a piston slideably supported within the cylinder bore;

a crankshaft rotatably supported by the engine block and rotatable about a crank axis;

a control shaft rotatably supported by the engine block and rotatable about a control axis, wherein the control axis is parallel with and laterally offset from the crank axis;

a link rod rotatably connected to the crankshaft;

a lower connecting rod having a first end rotatably connected to the link rod, and a second end rotatably connected to the control shaft;

an upper connecting rod having a first end rotatably connected to the link rod, and a second end rotatably connected to the piston;

wherein the second end of the lower connecting rod and the control shaft are rotatably connected at a location offset from the control axis to define an eccentric connection between the lower connecting rod and the control shaft relative to the control axis;

wherein the link rod includes a long arm portion extending along a long arm axis between a first end and a second end, with the link rod connected to the crank arm adjacent the first end of the link rod;

wherein the link rod includes an upper arm portion extending away from the long arm portion, along an upper arm axis, to a distal end, with the first end of the upper connecting rod connected to the link rod adjacent the distal end of the upper arm portion of the link rod, such that the first end of the upper connecting rod is connected to the distal end of the upper arm portion of the link rod at an upper connection location that is offset from the long arm portion; and wherein the link rod includes a lower arm portion extending away from the long arm portion, along a lower arm axis, to a distal end, with the first end of the lower connecting rod connected to the link rod adjacent the distal end of the lower arm portion of the link rod, such that the first end of the lower connecting rod is connected to the distal end of the lower arm portion of the link rod at a lower connection location that is offset from the long arm portion.

2. The internal combustion engine set forth in claim 1, wherein the crankshaft includes a crank arm extending away from the crank axis to a distal end, with the link rod connected to the crank arm adjacent the distal end of the crank arm and rotatable about a first axis relative to the crank arm, wherein the first axis is parallel with and laterally offset from the crank axis.

3. The internal combustion engine set forth in claim 2, wherein the upper connection location is disposed nearer the first axis than the lower connection location.

4. The internal combustion engine set forth in claim 1, wherein the upper arm portion and the lower arm portion are disposed on opposite sides of the long arm portion.

5. The internal combustion engine set forth in claim 1, wherein the long arm portion, the upper arm portion, and the lower arm portion form a generally "T" shaped structure.

6. The internal combustion engine set forth in claim 1, wherein the long arm axis and the upper arm axis form an upper angle between 30° and 90° therebetween.

7. The internal combustion engine set forth in claim 6, wherein the long arm axis and the lower arm axis form a lower angle between 90° and 150° therebetween.

8. The internal combustion engine set forth in claim 7, wherein the upper angle and the lower angle are complimentary angles.

9. The internal combustion engine set forth in claim 1, wherein the lower connecting rod is rotatable about a second axis relative to the control shaft, wherein the second axis is parallel with and laterally offset from the control axis.

10. The internal combustion engine set forth in claim 1, further comprising an actuator coupled to the control shaft and operable to rotate the control shaft about the control axis.

11. The internal combustion engine set forth in claim 10, wherein the actuator includes one of a linear actuator or a rotational actuator.

12. An internal combustion engine comprising:

an engine block defining a cylinder bore;

a piston slideably supported within the cylinder bore in a reciprocating motion through a compression stroke having a compression stroke length, and an expansion stroke having an expansion stroke length;

a crankshaft rotatably supported by the engine block and rotatable about a crank axis, wherein the crankshaft includes a crank arm extending away from the crank axis to a distal end;

a control shaft rotatably supported by the engine block and rotatable about a control axis, wherein the control axis is laterally offset from the crank axis;

a link rod rotatably connected to the crankshaft, with the link rod connected to the crank arm adjacent the distal end of the crank arm and rotatable about a first axis relative to the crank arm, wherein the first axis is parallel with and laterally offset from the crank axis;

a lower connecting rod rotatably connected to the control shaft, and rotatably connected to the link rod at a lower connection location;

an upper connecting rod rotatably connected to the piston, and rotatably connected to the link rod at an upper connection location;

wherein the upper connection location is disposed nearer the first axis than the lower connection location; and wherein rotational movement of the control shaft about the control axis rotates the second end of the lower connecting rod about the control axis to adjust the compression stroke length of the piston within the bore during the compression stroke of the piston.

13. The internal combustion engine set forth in claim 12, wherein:

the link rod includes a long arm portion extending along a long arm axis between a first end and a second end, with the link rod connected to the distal end of the crank arm adjacent the first end of the link rod;

the link rod includes an upper arm portion extending away from the long arm portion, along an upper arm axis, to a distal end, with a first end of the upper connecting rod connected to the link rod adjacent the distal end of the upper arm portion of the link rod, such that the first end of the upper connecting rod is connected to the distal end of the upper arm portion of the link rod at the upper connection location, with the upper connection location being offset from the long arm portion; and the link rod includes a lower arm portion extending away from the long arm portion, along a lower arm axis, to a distal end, with a first end of the lower connecting rod connected to the link rod adjacent the distal end of the lower arm portion of the link rod, such that the first end of the lower connecting rod is connected to the distal end of the lower arm portion of the link rod at the lower connection location, with the lower connection location being offset from the long arm portion.

14. The internal combustion engine set forth in claim 13, wherein:

the long arm axis and the upper arm axis form an upper angle between 30° and 90° therebetween; and the long arm axis and the lower arm axis form a lower angle between 90° and 150° therebetween.

15. The internal combustion engine set forth in claim 14, wherein the upper angle and the lower angle are complimentary angles.

16. The internal combustion engine set forth in claim 12, wherein the lower connecting rod is rotatable about a second axis relative to the control shaft, with the second axis being parallel with and laterally offset from the control axis.

17. The internal combustion engine set forth in claim 12, further comprising an actuator coupled to the control shaft and operable to rotate the control shaft about the control axis.

* * * * *